US009734835B2

(12) United States Patent
Fujieda

(10) Patent No.: US 9,734,835 B2
(45) Date of Patent: Aug. 15, 2017

(54) VOICE DECODING APPARATUS OF ADDING COMPONENT HAVING COMPLICATED RELATIONSHIP WITH OR COMPONENT UNRELATED WITH ENCODING INFORMATION TO DECODED VOICE SIGNAL

(71) Applicant: Oki Electric Industry Co., Ltd., Tokyo (JP)

(72) Inventor: Masaru Fujieda, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 170 days.

(21) Appl. No.: 14/614,790

(22) Filed: Feb. 5, 2015

(65) Prior Publication Data

US 2015/0262584 A1 Sep. 17, 2015

(30) Foreign Application Priority Data

Mar. 12, 2014 (JP) ..... 2014-049149

(51) Int. Cl.
*G10L 19/00* (2013.01)
*G10L 19/02* (2013.01)
(Continued)

(52) U.S. Cl.
CPC ..... *G10L 19/02* (2013.01); *G10L 19/087* (2013.01); *G10L 21/038* (2013.01)

(58) Field of Classification Search
USPC ..... 704/200–232, 500–504
See application file for complete search history.

(56) References Cited

U.S. PATENT DOCUMENTS 5,774,844 A * 6/1998 Akagiri ..... H04B 14/046 704/215
6,098,039 A * 8/2000 Nishida ..... G10L 19/0208 704/229

(Continued)

OTHER PUBLICATIONS

Researches and Investigations Society Information, "A Research and Examination Report Relating to Common Use Between a Frequency for an Analog Convenience Radio Station Using 150 MHZ Band and a Frequency for Digital Type", Hokuriku Bureau of Telecommunications, Ministry of Internal Affairs and Communications, 2011, Referred to in Paragraph 0003 of the Specification.

(Continued)

*Primary Examiner* — Jesse Pullias
(74) *Attorney, Agent, or Firm* — Rabin & Berdo, P.C.

(57) ABSTRACT

A voice decoding apparatus includes an MBE-type decoder, a sampling convertor, a non-linear components generator and an adder. The decoder decodes digital voice-encoded information to generate a first decoded voice signal. The convertor converts the first decoded voice signal to a second decoded voice signal with a higher sampling frequency. The generator performs a non-linear process to the first or second decoded voice signal to generate an additional voice signal with the same sampling frequency as the second decoded voice signal. The additional voice signal has components in a frequency band in which the first decoded voice signal has no component and continuing to another frequency band of the first decoded voice signal. The adder adds the second decoded voice signal to the additional voice signal.

19 Claims, 7 Drawing Sheets

(51) Int. Cl.
*G10L 19/087* (2013.01)
*G10L 21/038* (2013.01)

(56) References Cited

U.S. PATENT DOCUMENTS 6,449,596 B1 * 9/2002 Ejima ..... G11B 20/00007 704/501
6,658,382 B1 * 12/2003 Iwakami ..... G10L 19/0212 704/205
7,272,556 B1 * 9/2007 Aguilar ..... G10L 19/093 704/201
2006/0277038 A1 * 12/2006 Vos ..... G10L 19/0208 704/219

OTHER PUBLICATIONS

Daniel W. Griffin et al., "Multiband Excitation Vocoder", IEEE Transactions on Acoustics, Speech and Signal Processing, vol. ASSP-36, No. 8, pp. 1223-1235, Aug. 1988, Referred to in Paragraph 0012 of the Specification.

* cited by examiner

PRIOR ART

PRIOR ART

VOICE DECODING APPARATUS OF ADDING COMPONENT HAVING COMPLICATED RELATIONSHIP WITH OR COMPONENT UNRELATED WITH ENCODING INFORMATION TO DECODED VOICE SIGNAL

BACKGROUND OF THE INVENTION

Field of the Invention

The present invention relates to a voice decoding apparatus, and more particularly, to a voice decoding apparatus for decoding a voice signal encoded by a Multi-Band Excitation (MBE) type voice encoding system.

Description of the Background Art

In Japan, the Radio Law has been revised because of concern as to an increase in demand of data transmission and tightness of frequencies. From the revision, a telecommunications system of a so-called convenience radio device has been determined so as to be completely shifted from a conventional analog type to a digital type. In response to such a trend, a standard relating to the telecommunications system of the digital type convenience radio device, i.e. a digital radio device, is determined by Association of Radio Industries and Businesses (ARIB). With regard to a 4-level FSK (Frequency Shift Keying) modulation system often applied to a specified low power radio device, a 4-FSK communication radio system for broadcasting business, e.g. ARIB STD-B54, is determined in a broadcasting field and a narrow band digital communication system, e.g. SCPC (Single Channel Per Carrier)/a 4-level FSK type, i.e. ARIB STD-T102, is determined in a telecommunications field. As to voice encoding system, the standards in both the fields describes that "AMBE+2 (Advanced Multi-Band Excitation plus two) Enhanced Half-Rate in Digital Voice System, Inc. is recommended". The trade mark AMBE+2 (occasionally written as AMBE++) is held by Digital Voice System, Inc.

AMBE+2 has two advantages as compared with other voice encoding systems in that a decoded voice hardly sounds unnaturally in noisy environment and that a stable quality is provided in low bit rate. However, the Researches and Investigations Society Information, "A Research and Examination Report Relating to Common Use between a Frequency for an Analog Convenience Radio Station Using 150 MHz Band and a Frequency for Digital Type", Hokuriku Bureau of Telecommunications, Ministry of Internal Affairs and Communications, 2011, reported that "a voice sounds like clogging a nose". Thus, AMBE+2 has a disadvantage of degrading the quality of sound.

AMBE+2 is an advanced system based on MBE (Multi-Band Excitation) as the voice encoding system, and AMBE is aberration on Advanced MBE. In addition to AMBE, there is another voice encoding system called as IMBE (Improved MBE). AMBE or AMBE+2, and IMBE are based on MBE. In this specification, MBE, AMBE and IMBE may be called as a "MBE-type voice encoding system". The term "MBE voice encoding system" herein indicates that MBE is used as the voice encoding system.

However, as reported by the above-mentioned Research and Examination Report, the MBE-type voice encoding system has a problem that the decoded voice becomes like clogging a nose. Hereinafter, such sound quality will be called as a "nose clogging feeling".

SUMMARY OF THE INVENTION

It is therefore an object of the present invention to provide a voice decoding apparatus capable of obtaining a decoded voice sounding naturally with a nose clogging feeling reduced, according to the MBE-type voice encoding system.

In accordance with the present invention, a voice decoding apparatus for decoding a digital voice-encoded information encoded in accordance with an MBE-type voice encoding system includes an MBE-type decoder, a sampling convertor, a non-linear components generator and an adder. The MBE-type decoder decodes the digital voice-encoded information to generate a first decoded voice signal with a first sampling frequency. The sampling convertor converts the first decoded voice signal to a second decoded voice signal with a second sampling frequency higher than the first sampling frequency. The non-linear components generator performs a non-linear process to the first or second decoded voice signal to generate an additional voice signal with the second sampling frequency so that there are components in a frequency band in which the first decoded voice signal has no component and there is no component in another frequency band in which the first decoded voice signal has components. The adder adds the second decoded voice signal and additional voice signal to each other.

Moreover, in accordance with the invention, a non-transitory computer-readable medium stores a voice decoding program for causing a computer, which implements a voice decoding apparatus for decoding a digital voice-encoded information encoded in accordance with an MBE-type voice encoding system, to function as an MBE-type decoder, a sampling convertor, a non-linear components generator and an adder. The MBE-type decoder decodes the digital voice-encoded information to generate a first decoded voice signal with a first sampling frequency. The sampling convertor converts the first decoded voice signal to a second decoded voice signal with a second sampling frequency higher than the first sampling frequency. The non-linear components generator performs a non-linear process to the first or second decoded voice signal to generate an additional voice signal with the second sampling frequency so that there are components in a frequency band in which the first decoded voice signal has no component and there is no component in another frequency band in which the first decoded voice signal has components. The adder adds the second decoded voice signal and additional voice signal to each other.

According to the present invention, in the voice decoding apparatus, it is possible to provide the auditor with the voice improved in nose clogging feeling of the decoded voice in hearing sense and enhanced in listening feeling, while attaining the advantage of obtaining a stable quality of the decoded voice in the MBE-type voice encoding system.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Before describing preferred embodiments of the present invention, related technique will be described in order to facilitate understanding of the embodiments.

Figure 7:
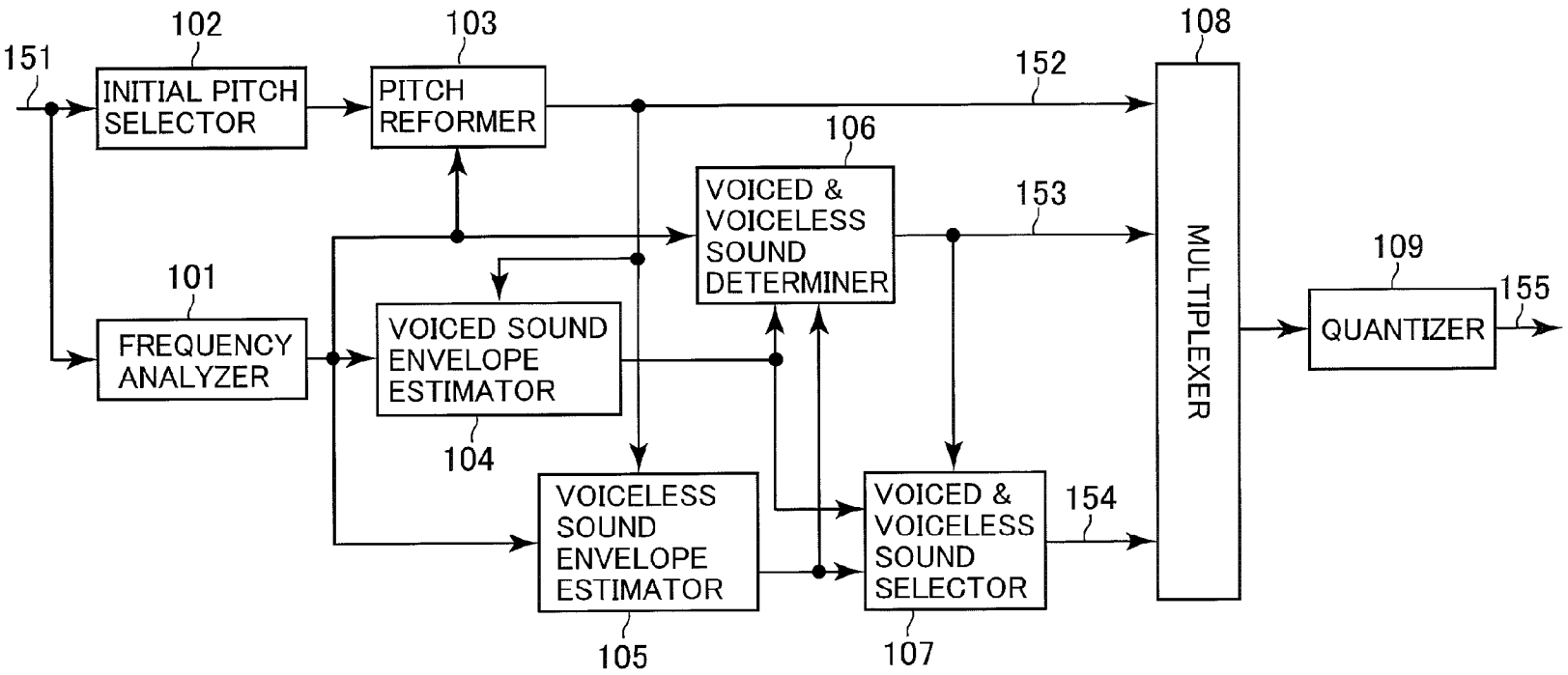
FIG. 7 is a schematic block diagram showing an example of a voice encoding apparatus in accordance with an MBE-type voice encoding system.

FIG. 7 shows a configuration example of a voice encoding apparatus in accordance with an MBE voice encoding system based on the solution disclosed in Daniel W. Griffin et al., "Multiband Excitation Vocoder", IEEE Transactions on Acoustics, Speech and Signal Processing, vol. ASSP-36, no. 8, pp. 1223-1235, 1988.

In FIG. 7, the voice encoding apparatus 100 is provided with a frequency analyzer 101, an initial pitch selector 102, a pitch reformer 103, a voiced sound envelope estimator 104, a voiceless sound envelope estimator 105, a voiced and voiceless sound determiner 106, a voiced and voiceless sound selector 107, a multiplexer 108 and a quantizer 109.

A voice signal detected with a microphone or the like is digitalized by an analog to digital (A/D) convertor, not shown, and then, the digitalized voice signal, i.e. an input voice signal 151, is input into the voice encoding apparatus 100. The frequency analyzer 101 converts a time-domain wave form of the input signal 151 to a frequency spectrum, i.e. an input spectrum, by an Overlapped Windowed FFT (Fast Fourier Transform). The initial pitch selector 102 selects a pitch period, i.e. an initial pitch, indicated with an integer sample value by means of dynamic programming on the basis of a condition of minimizing a harmonic model error in a case of assuming an input voice signal 151 as a complete voiced sound. The initial pitch selector 102 transmits the resultant initial pitch to the pitch reformer 103. In order to reduce the harmonic model error, the pitch reformer 103 updates the initial pitch to a pitch period, i.e. a real number pitch, indicated with a higher precision real number sample value on the basis of the input spectrum from the frequency analyzer 101.

The voiced sound envelope estimator 104 estimates envelope information of the voiced sound having the minimum harmonic model error on the basis of the input spectrum from the frequency analyzer 101 and the real number pitch 152 from the pitch reformer 103. The envelope information of the voiced sound may be power and phase for each harmonic component. Under the assumption that harmonic components are a noise, the voiceless sound envelope estimator 105 calculates the power for each harmonic band as envelope information of the voiceless sound, on the basis of the input spectrum and real number pitch 152. The harmonic band is a band occupied by harmonic components in the voiced sound and is defined by the real number pitch 152. Adjacent harmonic bands are not overlapped with and not separated from each other. The voiced and voiceless sound determiner 106 determines whether each harmonic band is the voiced sound or the voiceless sound, on the basis of the input spectrum, the harmonic model error of the harmonic band calculated from the voiced sound envelope information, and the voiceless sound envelope information. The voiced and voiceless sound determiner 106 outputs the resultant as voiced and voiceless sound information 153. The voiced and voiceless sound selector 107 alternately selects the voiced sound and the voiceless sound envelope information for each harmonic band on the basis of the voiced sound or voiceless sound information 153.

The multiplexer 108 unifies pitch information such as real number pitch 152, the voiced and voiceless sound information 153 for each harmonic band and the envelope information 154 for each harmonic band into one series, i.e. encoding information. The quantizer 109 quantizes the encoding information, for instance, so as to have the bit number defined for each element, and outputs the resultant digital voice-encoded information 155.

Figure 8:
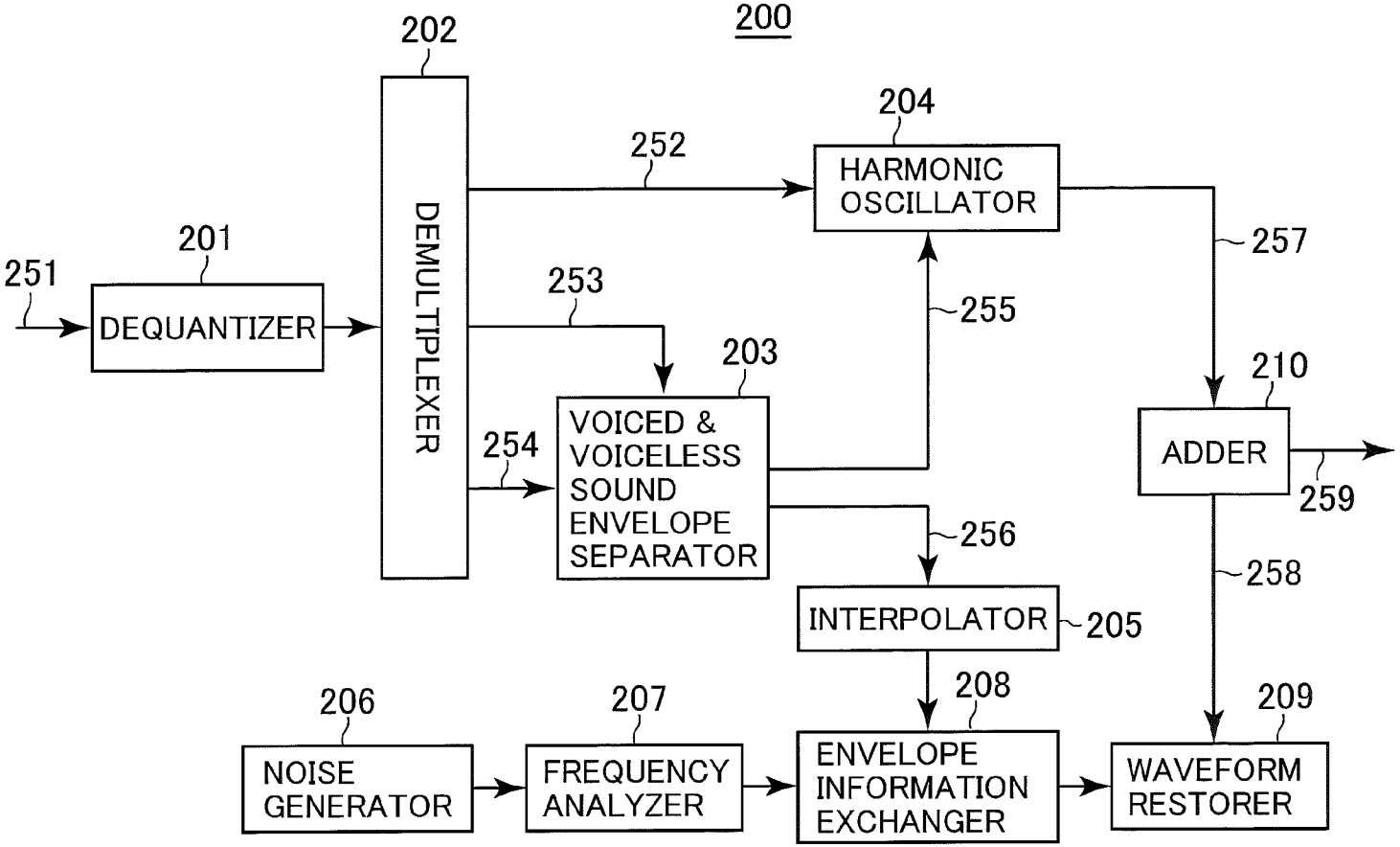
FIG. 8 is a schematic block diagram showing an example of a voice decoding apparatus in accordance with the MBE-type voice encoding system.

FIG. 8 shows a configuration example of a voice decoding apparatus according to an MBE encoding system based on the solution taught by Daniel et al. The voice decoding apparatus 200 shown in FIG. 8 is contrasted with the above-mentioned voice encoding apparatus 100 to receive the digital voice-encoded information 251 output by the voice encoding apparatus 100.

As shown in FIG. 8, the voice decoding apparatus 200 is provided with a dequantizer 201, a demultiplexer 202, a voiced and voiceless sound envelope separator 203, a harmonic oscillator 204, an interpolator 205, a noise generator 206, a frequency analyzer 207, an envelope information exchanger 208, a waveform restorer 209 and an adder 210.

In FIG. 8, the dequantizer 201 estimates the encoding information before quantization from the received digital voice-encoded information by dequantization. The demultiplexer 202 demultiplexes the dequantized voice-encoded information to extract the pitch information 252, voiced and voiceless sound information 253 and envelope information 254.

The voiced and voiceless sound envelope separator 203 separates the envelope information 254 into voiced sound envelope information 255 and voiceless sound envelope information 256 on the basis of the demultiplexed voiced and voiceless sound information 253. In the voiced sound envelope information 255, the power and phase of voiceless harmonic band are equal to zero. In the voiceless sound envelope information 256, the power and phase of voiced sound harmonic band are equal to zero. The harmonic oscillator 204 generates a sinusoidal wave signal based on the amplitude and phase of the voiced sound envelope information 255 for each harmonic component from the pitch information 252 and envelope information, and sums up, i.e. synthesizes the sinusoidal wave signals of all the harmonic components to obtain the voiced sound signal 257. The generated sinusoidal wave signal is adjusted so that the amplitude and phase are continuous.

The interpolator 205 interpolates the voiceless sound envelope information 256 in accordance with the frequency resolution of the frequency analyzer 207, for instance, by linear interpolation to obtain a voiceless amplitude spectrum. The noise generator 206 generates a white noise by a well-known way. The frequency analyzer 207 converts the frequency of a white noise signal from the noise generator 206 by using parameters which are the same as the above-mentioned frequency analyzer 101 to obtain a noise spectrum. The envelope information exchanger 208 calculates a voiceless spectrum by multiplying the noise spectrum from the analyzer 207 by the voiceless amplitude spectrum from the interpolator 205. The waveform restorer 209 executes IFFT (Inverse FFT) and overlap addition on the voiceless spectrum by using correspondent parameters with the analyzer 207 to generate a voiceless sound signal 258.

The adder 210 adds the voiced sound signal 257 from the harmonic oscillator 204 to the voiceless sound signal 258 from the waveform restorer 209 to obtain and output encoded voice signal.

As mentioned above, the configurations and operations of the voice encoding apparatus 100 and voice decoding apparatus 200 according to the MBE encoding system have been described. AMBE encoding system and IMBE encoding system are different from the MBE encoding system in parameter estimation, and the accuracy and way of quantization, but similar in principle. Every MBE-type voice encoding system may provide high resistance to the noise and stable quality in low bit rate.

Next, the grounds on which a nose clogging feeling of a decoded voice according to an MBE-type voice encoding system can be improved by the voice decoding apparatus of the embodiments will be described.

First, it will be considered how the nose clogging feeling occurs. In a decoding operation of the MBE-type voice encoding system, sinusoidal wave signals are summed up to obtain the voiced sounds. The sinusoidal wave signal is generated on the basis of pitch information and envelope information obtained from digital voice-encoded information. The pitch and envelope information are discrete values for each frame, i.e. a group of voice samples of which number or period is predetermined. To generate the sinusoidal wave signal, the information is used as just it is or the information is used after suitably interpolated for each sample. The mechanically synthesized voice has an artificial waveform. More specifically, the pitch and envelope information of the voice originally uttered by a human has small and irregular fluctuation for each sample regardless of his or her intention. However, the mechanically synthesized voice signal does not have such irregular fluctuation. The decoded voice therefore feels like the artificial tone quality on a hearing feeling. It is deemed that the artificial feeling is sensed as the nose clogging feeling.

Next, it will be described how the voice decoding apparatus of embodiments of the invention improves the nose clogging feeling. The voice decoding apparatus of the embodiments is generally provided with an MBE-type decoder, a sampling convertor, a non-linear components generator and an adder, as the elements. The MBE-type decoder decodes the digital voice-encoded information to generate a first decoded voice signal sampled in a first sampling frequency. The sampling convertor converts the first decoded voice signal to a second decoded voice signal with a second sampling frequency higher than the first sampling frequency. The non-linear components generator performs non-linear process to the first or second decoded voice signal to generate an additional voice signal with the second sampling frequency so that there are components in a frequency band in which the first decoded voice signal has no component and there is no component in another frequency band in which the first decoded voice signal has components. The adder adds the second decoded voice signal to the additional voice signal.

Hereinafter, for convenience, the first and second decoded voice signals will simply be called as a decoded voice signal when referring to both decoded voice signals regardless of sampling frequency. In addition, the half of the first sampling frequency is called as a first Nyquist frequency. The half of the second sampling frequency is called as a second Nyquist frequency. A lower band than the first Nyquist frequency is called as a first band. A higher band than the second Nyquist frequency is called as a second band. A band with the first decoded voice's components is called as a decoded voice band. A higher band than the decoded voice band is called as an additional voice band.

The noise clogging feeling occurs by mechanical synthesis to obtain the voiced sound by using discrete encoding information for each frame. The inventor therefore considers that, when components having a complicated relationship with the encoding information or unrelated components with the encoding information are added to the decoded voice signal, it is possible to reduce an influence of the synthesis using the encoding information and to reduce the nose clogging feeling.

The complicated relationship is, for instance, a non-linear relationship. An example of the components with the non-linear relationship is the components obtained by adding the additional voice signal which has components in the additional voice band to the second decoded voice signal. According to this method, the unrelated components to the encoding information or the components having a complicated relationship with the encoding information can be easily added. By contrast, an example of components with a linear relationship is the additional voice signal with a high frequency band of the first decoded voice signal enhanced. However, in a way of adding such an additional voice signal to the first decoded voice signal, because the influence of the encoding information remains roughly completely, the nose clogging feeling cannot be reduced.

As mentioned above, the addition of the additional voice signal with some component in the additional voice band to the second decoded voice signal is an efficient manner to reduce the nose clogging feeling. However, if the stable quality of the decoded voice in the MBE-type voice encoding system is degraded by such addition, the effect of the reduction of the nose clogging feeling does not make sense. Therefore, in order to prevent the stable quality of the decoded voice in the MBE-type voice encoding system from degrading even when the additional voice signal is added, the additional voice signal should not have the decoded voice band's components. This is because the additional voice signal tends to have a noisy tone quality and distorted tone quality, and a risk of decreasing the quality occurs if the additional voice signal with the decoded voice band's components is generated and added to the second decoded voice signal. The additional voice signal is required to be unrelated with the encoding information or to have the complicated relationship with the encoding information. However, there is no requirement for the band of the additional voice signal, and it is therefore unnecessary that the additional voice band has the decoded voice band's components.

As is clear from the above-mentioned matters, when the non-linear components generator generates the additional voice signal with the additional voice band's components to add the additional voice signal to the second decoded voice signal, it is possible to reduce the nose clogging feeling, while keeping the stable quality of the decoded voice in the MBE-type voice encoding system.

Now, the voice decoding apparatus according to a first embodiment of the present invention will be described with reference to the drawings. The voice decoding apparatus of the first embodiment, as well as the below-mentioned embodiments, is configured to carry out decoding in accordance with the MBE-type voice encoding system.

Figure 1:
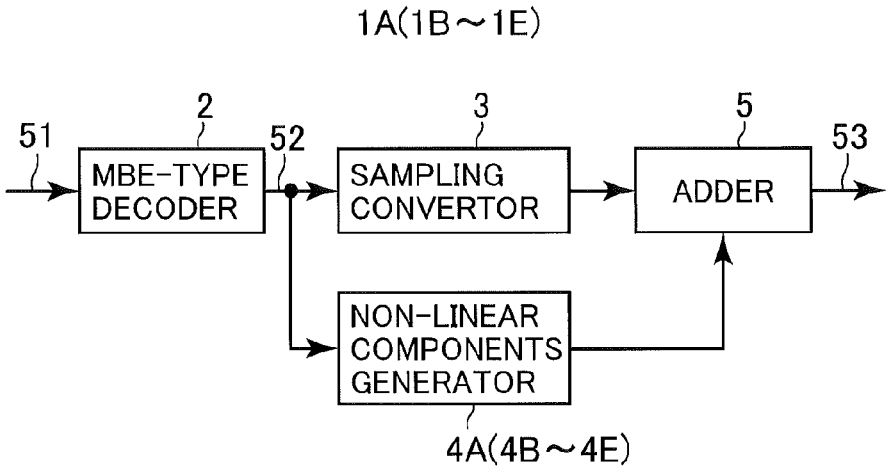
FIG. 1 is a schematic block diagram showing a voice decoding apparatus according to a first embodiment of the present invention.

FIG. 1 is a functional block diagram showing a structure of the voice decoding apparatus of the first embodiment. The voice decoding apparatus of the first embodiment may be configured by hardware or a processor system including a CPU (Central Processing Unit) and software (e.g. a voice decoding program) executed by the CPU. In both configurations, the voice decoding apparatus may be functionally represented as shown in FIG. 1.

The digital voice-encoded information encoded in accordance with the MBE-type voice encoding system by a voice encoding apparatus, connected to the voice decoding apparatus, is sent out on a wireless or wired channel by a transmitting section. The sent out information, i.e. transmission signal of the digital voice-encoded information, is received from the channel by a receiving section, not shown. The received digital voice-encoded information 51 is transmitted to the voice encoding apparatus 1A of the first embodiment.

In FIG. 1, the voice encoding apparatus 1A of the first embodiment is provided with an MBE-type decoder 2, a sampling convertor 3, a non-linear components generator 4A and an adder 5. Note that reference numerals 1B-1E and 4B-4E in FIG. 1 are used in other embodiments.

The MBE-type decoder 2 is configured to decode the digital voice-encoded information 51 by means of a decoding manner correspondent with an encoding manner used for generation of this information. The decoder 2 transmits the resultant first decoded voice signal 52 to the sampling convertor 3 and non-linear components generator 4A.

The voice encoding system relating to the decoding and encoding manners may be any of the MBE-type voice encoding systems, for example, the MBE encoding system mentioned above with reference to FIGS. 7 and 8, or the AMBE or AMBE+2 encoding system or the IMBE encoding system mentioned earlier.

The sapling convertor 3 is configured to convert the first decoded voice signal 52 with the first sampling frequency to a decoded voice signal with the second sampling frequency higher than the first sampling frequency, and transmits the resultant sampling-converted decoded voice signal, i.e. the above-mentioned second decoded voice signal, to the adder 5.

Since the MBE voice encoding system does not depend on the sampling frequency in principle, the first sampling frequency is arbitrarily determined. Because all the MBE, AMBE and IMBE voice encoding systems often use the first sampling frequency of 8 kHz in practice, a case using the first sampling frequency of 8 kHz will be described herein. The second sampling frequency is arbitrarily determined under a condition of being higher than the first sampling frequency. Using twice the first sampling frequency as the second sampling frequency allows a simple implementation. In view of improving sound quality, e.g. reducing the nose clogging feeling, it is sufficient that the second sampling frequency is extended to twice as high as the first sampling frequency. Therefore, a case using the second sampling frequency of 16 kHz will be described herein.

The non-linear components generator 4A is configured to perform a non-linear process to the first decoded voice signal 52 to generate the additional voice signal with additional voice band's components and to transmit the additional voice signal to the adder 5. Note that non-linear components generators 4B-4E in the following second to fifth embodiments have the same fundamental function as the non-linear components generator 4A of the first embodiment.

The adder 5 is configured to add the second decoded voice signal and additional voice signal to generate improved voice signal 53 and output the improved voice signal 53. The additional voice signal is filtered so that the decoded voice band has no component. The improved voice signal is therefore determined as a voice signal including the decoded voice band, in which original decoded voice's components remain, and the additional voice band, in which new components are added.

The additional voice signal with the additional voice band's components generated by the non-linear components generator 4A necessarily has a non-linear relationship with the decoded voice signal. Therefore, the additional voice signal may be called as non-linear components and a way of generating the non-linear components may be called as a non-linear component generating way.

There are various non-linear component generating ways. The voice decoding apparatuses 1A-1E of the first-fifth embodiments are different from each other in the non-linear components generating ways of the non-linear components generators 4A-4E.

Figure 2:
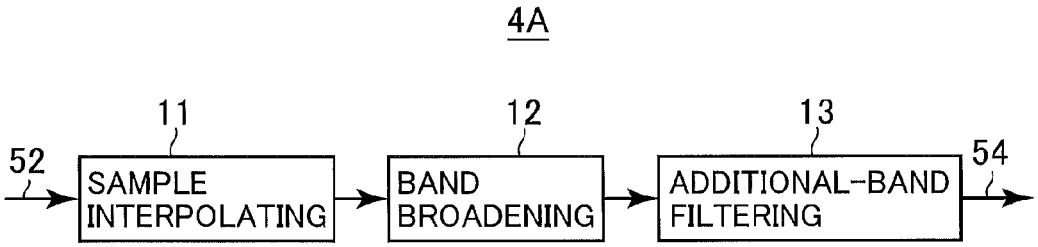
FIG. 2 is a schematic block diagram showing a non-linear components generator in the voice decoding apparatus according to the first embodiment.

FIG. 2 is a schematic block diagram showing a detail configuration of the non-linear components generator 4A in the voice decoding apparatus 1A of the first embodiment.

In FIG. 2, the non-linear components generator 4A is provided with a sample interpolating section 11, a band broadening section 12 and an additional-band filtering section 13.

The sample interpolating section 11 is configured to insert a new sample in every sample of the first decoded voice signal 52 output from the MBE-type decoder 2 under an interpolation rule. The sample interpolating section 11 accordingly converts the sampling frequency from the first sampling frequency to the second sampling frequency, for example, from 8 kHz to 16 kHz in the first embodiment, and transmits the resultant interpolated voice signal to the band broadening section 12. The sample interpolating section 11 may apply, as the interpolation rule, any existing interpolation rule, preferably apply a rule of inserting zero or a rule of inserting the same value as a sample just before the inserting position, which is called as a zero-order holding. In addition, the sample interpolating section 11 may shape the waveform by means of predetermined signal processing before or after the sample interpolation. If the interpolated voice signal is shaped by an aliasing filter for filtering components of the first Nyquist frequency or less from interpolated voice signal after the interpolation under the zero inserting rule, instead of receiving and processing the first decoded voice signal in the sample interpolating section 11, the above-mentioned sampling convertor 3 may be used as the sample interpolating section 11 to transmit the second decoded voice signal output from the sampling convertor 3 to the band broadening section 12.

The band broadening section 12 is configured to perform a non-linear process to the interpolated voice signal to generate a signal with the additional voice band's components and to transmit the resultant provisional additional voice signal to the additional-band filtering section 13. The band broadening section 12 may apply, as the non-linear process, any existing non-linear process. It is preferable to apply, for instance, a manner of shifting a part of the decoded voice band to the additional voice band by filtering the part from the decoded voice signal with a band pass filter and carrying out Hilbert-conversion on the filtered part, and multiplying the resultant signal by a sinusoidal wave analytical signal, or a manner of a non-linear amplitude modulation with a rectification process or an exponential process. Moreover, in accordance with the applied non-linear process, a filter process for filtering a desired band of the interpolated voice signal may be carried out before the non-linear process. For instance, if the rectification process is carried out as the non-linear process, it is preferable to apply a filter for filtering out a band from 2 kHz to 4 kHz.

The additional-band filtering section 13 is configured to filter the additional voice band from the provisional additional voice signal and to output the resultant additional voice signal 54. The filter for use in the filtering only needs to have a characteristic of cutting off the decoded voice band. For instance, a high pass filter for filtering the entire additional voice band may be applied or a band pass filter for filtering a part of the additional voice band may be applied. Moreover, a desired signal processing for shaping the waveform may be carried out before or after filtering the additional voice band.

Now, the general operation of the voice decoding apparatus 1A of the first embodiment and the operation of the non-linear components generator 4A will be described in this order.

The digital voice-encoded information encoded in accordance with the MBE-type voice encoding system by the voice encoding apparatus, connected to the voice decoding apparatus 1A, is transmitted to a voice receiving device including the voice decoding apparatus 1A of the first embodiment over the wireless or wired channel. The information is received by a receiving section (not shown) and the received digital voice-encoded information 51 is transmitted to the voice decoding apparatus 1A of the first embodiment.

The digital voice-encoded information 51 is decoded by the MBE-type decoder 2 in the voice decoding apparatus 1A in the decoding manner correspondent with the encoding manner used for generation of this information. The resultant first decoded voice signal with the first sampling frequency is transmitted to the sampling convertor 3 and the non-linear components generator 4A.

The first decoded voice signal output from the MBE-type decoder 2 is converted to the decoded voice signal with the second sampling frequency higher than the first sampling frequency by the sampling convertor 3. The resultant second decoded voice signal after sampling conversion is transmitted to the adder 5.

With regard to the first decoded voice signal output from the MBE-type decoder 2, the non-linear process is performed by the non-linear components generator 4A to generate the additional voice signal with the additional voice band's components. The additional voice signal is transmitted to the adder 5.

The second decoded voice signal and additional voice signal are added by the adder 5 to generate the improved voice signal. The improved voice signal is sent out as the output of the voice decoding apparatus 1A to the subsequent stage.

Now, the operation in the non-linear components generator 4A of the voice decoding apparatus 1A will be described. The first decoded voice signal output from the MBE-type decoder 2 is interpolated with the sample interpolating section 11 by inserting a new sample in every sample under the predetermined interpolation rule. By this interpolation process, the sampling frequency of the first decoded voice signal is converted from the first sampling frequency to the second sampling frequency. The resultant interpolated voice signal is then transmitted to the band broadening section 12.

With regard to the interpolated voice signal, the predetermined non-linear process is performed by the band broadening section 12 to generate a signal with the additional voice band's components. The resultant provisional additional voice signal is transmitted to the additional-band filtering section 13.

The additional voice band's components are filtered from the provisional additional voice signal, and the resultant, i.e. remaining, additional voice signal is transmitted to the adder 5.

In accordance with the first embodiment, it is possible to provide the auditor with the voice improved in the nose clogging feeling of the decoded voice in hearing sense and enhanced in the listening feeling, while retaining the advantage of obtaining a stable quality of the decoded voice in the MBE-type voice encoding system.

Next, a voice decoding apparatus according to a second embodiment of the present invention will be described further with reference to FIG. 3.

The voice decoding apparatus of the second embodiment is configured by suitably modifying the voice decoding apparatus of the first embodiment to reduce the nose clogging feeling of the decoded voice signal.

The second embodiment may be different from the first embodiment in the non-linear components generating way performed by the non-linear components generator. As described above, the first embodiment may apply the existing manner for generating the voice with the additional voice band's components. In the first embodiment, in a case of applying a manner of shifting a part of the decoded voice band to the additional voice band by filtering the decoded voice signal with the band pass filter and carrying out Hilbert-conversion on the filtered part, and multiplying the resultant signal by the sinusoidal wave analytical signal, the discrete encoding information for each frame remaining in the decoded voice band may influence on the additional voice band, and accordingly, the effect of improving the nose clogging feeling may be limitative.

Thereupon, the second embodiment utilizes non-linear amplitude modulation as a manner of generating the voice with the additional voice band's components. According to this, irregularity not generated from the encoding information can be included in the additional voice band's components, and it is thereby expected that the voice further improved in the nose clogging feeling is obtained.

The general configuration of the voice decoding apparatus 1B according to the second embodiment may be similar to the configuration as shown in FIG. 1 applied to the first embodiment. The voice decoding apparatus 1B is provided with a non-linear components generator 4B in addition to the MBE-type decoder 2, the sampling convertor 3, and the adder 5.

The non-linear components generator 4B is different in detail configuration from the first embodiment. FIG. 3 is a schematic block diagram showing a detail configuration of the non-linear components generator 43 in the second embodiment.

Figure 3:
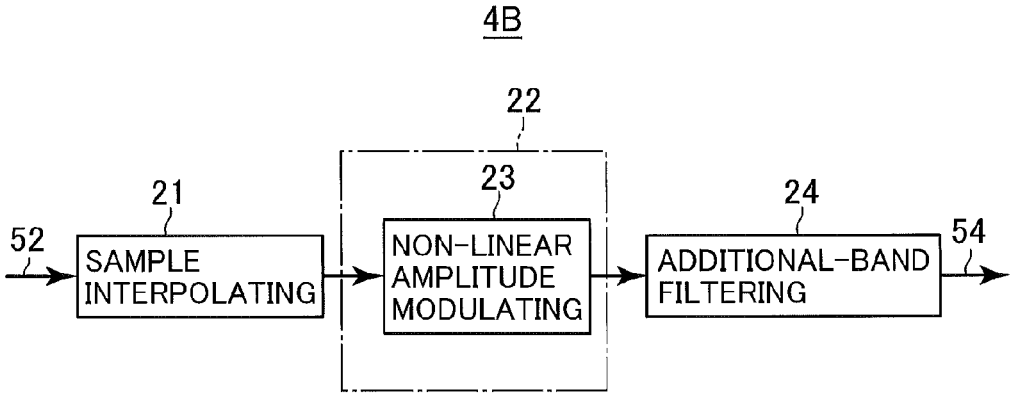
FIG. 3 is a schematic block diagram showing a non-linear components generator in a voice decoding apparatus according to a second embodiment of the present invention.

In FIG. 3, the non-linear components generator 4B in the second embodiment is provided with a sample interpolating section 21, a band broadening processing section 22 and an additional-band filtering section 24. The sample interpolating section 21 and the additional-band filtering section 24 may be the same as or similar to the sample interpolating section 11 and the additional-band filtering section 13 in the first embodiment, respectively, and a repetitive description of their functions is omitted.

The band broadening processing section 22 is configured by a non-linear amplitude modulating section 23. The non-linear amplitude modulating section 23 is configured to amplitude-modulate the interpolated voice signal received from the sample interpolating section 21 by using a non-linear function, and to transmit the resultant provisional additional voice signal to the additional-band filtering section 24.

As the non-linear function, any of the existing non-linear functions may be applied. For instance, it is preferable to apply full wave rectification (e.g. an absolute value function), half wave rectification (e.g. a function of representing positive input with linear and negative input with zero) or square function as the non-linear function, in order to provide harmonic structure of the decoded voice band in the additional voice band. Moreover, depending on the non-linear function applied, a process for filtering a desired band from the interpolated voice signal may be carried out before the non-linear amplitude modulation. For example, in a case of the full wave rectification or an absolute value function, it is preferable to apply a filter for filtering out a band from 2 kHz to 4 kHz.

Now, the operation of the voice decoding apparatus 1B of the second embodiment will be described. The general operation of the voice decoding apparatus 1B may be similar to the first embodiment and a repetitive description is omitted. The operation of the non-linear components generator 4B will be described.

The first decoded voice signal output from the MBE-type decoder 2 is interpolated with the sample interpolating section 21 by inserting a new sample in every sample under the interpolation rule. By this interpolation process, the sampling frequency of the first decoded voice signal is converted from the first sampling frequency to the second sampling frequency. The resultant interpolated voice signal is then transmitted to the non-linear amplitude modulating section 23 constituting the band broadening processing section 22.

With regard to the interpolation voice, a non-linear function, e.g. the full wave rectification, half wave rectification or square function, is applied by the non-linear amplitude modulating section 23 to perform the amplitude modulation. The resultant provisional additional voice signal is transmitted to the additional-band filtering section 24.

By the additional-band filtering section 24, the additional voice band is filtered from the provisional additional voice signal, and the resultant additional voice signal is transmitted to the adder 5.

In accordance with the second embodiment, by including the characteristic not generated from the discrete encoding information for each frame in the additional voice band, it is possible to provide the auditor with the voice further improved in the nose clogging feeling of the decoded voice signal in hearing sense and enhanced in the listening feeling, while maintaining the advantage of obtaining the stable quality of the decoded voice in the MBE-type voice encoding system.

Next, the voice decoding apparatus according to a third embodiment of the present invention will be described further with reference to FIG. 4. The voice decoding apparatus of the third embodiment is configured by suitably modifying the voice decoding apparatus of the first embodiment in a different approach from the second embodiment to reduce the nose clogging feeling of the decoded voice signal.

The third embodiment may be different from the first embodiment in the non-linear components generating way performed by the non-linear components generator. As described earlier, the first embodiment uses only the decoded voice signal to generate the voice signal with the additional voice band's components. In the first embodiment, for instance, in a case of applying a manner of shifting a part of the decoded voice band to the additional voice band by filtering the decoded voice signal with the band pass filter and carrying out Hilbert-conversion on the filtered part, and multiplying the resultant signal by the sinusoidal wave analytical signal, the discrete encoding information for each frame remaining in the decoded voice band may influence on the additional voice band, and accordingly, an effect of improving the nose clogging feeling may be limitative.

Thereupon, in the third embodiment, a noise signal is additionally applied to generate the voice with the additional voice band's components. According to this, a characteristic not generated from the encoding information can be included in the additional voice band's components, and it is thereby expected that the voice further improved in the nose clogging feeling is obtained.

The general configuration of the voice decoding apparatus 1C according to the third embodiment may be similar to the configuration as shown in FIG. 1 applied to the first embodiment. The voice decoding apparatus 1C is provided with a non-linear components generator 4C in addition to the MBE-type decoder 2, the sampling convertor 3, and the adder 5.

The non-linear components generator 4C is different in detail configuration from the above-mentioned embodiments. FIG. 4 is a schematic block diagram showing a detail configuration of the non-linear components generator 4C in the third embodiment.

Figure 4:
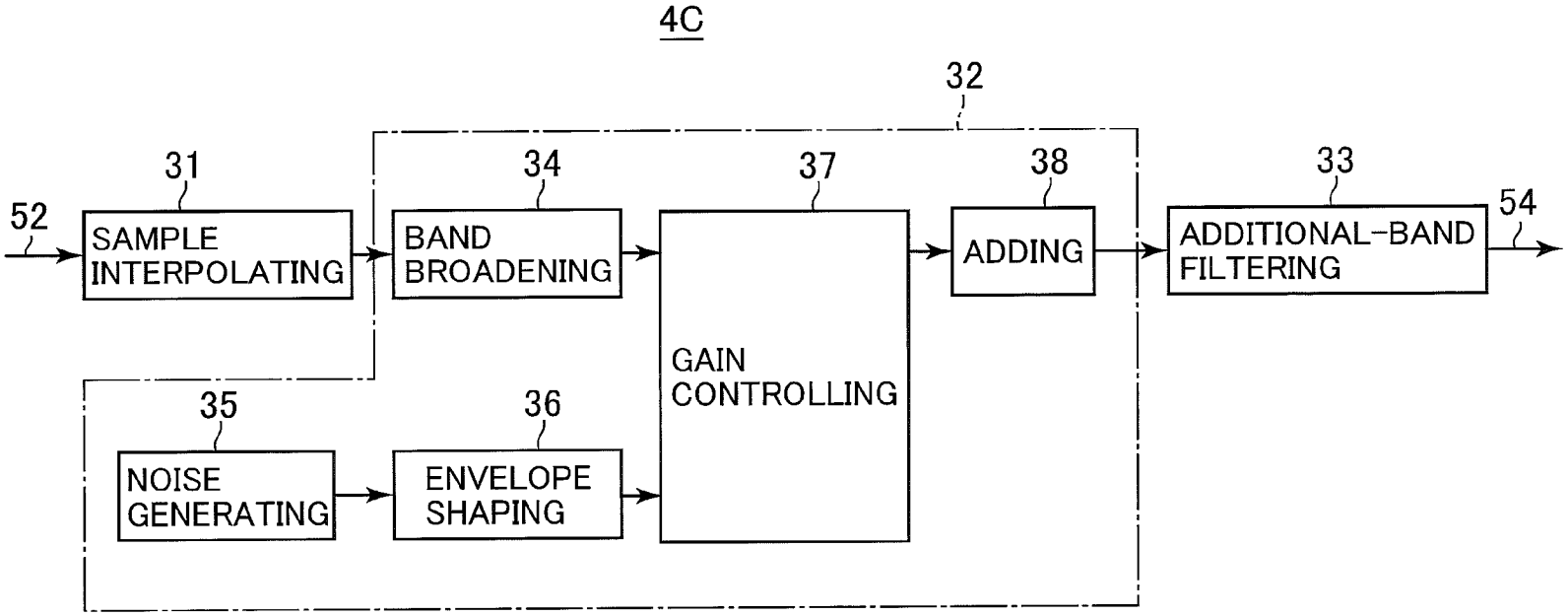
FIG. 4 is a schematic block diagram showing a non-linear components generator in a voice decoding apparatus according to a third embodiment of the present invention.

In FIG. 4, the non-linear components generator 4C in the third embodiment is provided with a sample interpolating section 31, a band broadening processing section 32 and an additional-band filtering section 33. The sample interpolating section 31 and the additional-band filtering section 33 may be the same as or similar to the sample interpolating section 11 and the additional-band filtering section 13 in the first embodiment, respectively, and a repetitive description of their functions is omitted.

The band broadening processing section 32 is provided with a band broadening section 34, a noise generating section 35, an envelope shaping section 36, a gain controlling section 37 and an adding section 38.

The band broadening section 34 may be the same as or similar to the band broadening section 12 of the first embodiment, and serves as a band broadening element. Specifically, the band broadening section 34 performs the non-linear process to the interpolated voice signal received from the sample interpolating section 31 to generate the signal with the additional voice band's components and transmits the resultant broad band signal to the gain controlling section 37. Incidentally, the configuration of the band broadening processing section 22 of the second embodiment may be applied to the band broadening section 34 of the third embodiment.

The noise generating section 35 is configured to generate a noise signal by means of a pseudo-random number generating way and transmit the resultant noise signal to the envelope shaping section 36. As the pseudo-random number generating way, any existing pseudo-random number generating way may be applied. The period of the pseudo-random number only needs to have a length such that periodicity of the noise component is not felt in hearing sense. For example, a period of 16000 samples or more is sufficient for the pseudo-random number. As a way of generating such a pseudo-random number, a linear congruential generator with small operation quantity or a way of using a linear feedback shift register is preferable.

The envelope shaping section 36 is configured to perform a process for adjusting spectral envelope to the noise signal and transmits the resultant envelope-adjusted noise signal to the gain controlling section 37. If the noise signal is generated in the above-mentioned way, the noise signal is white noise with flat spectral shape. On the other hand, the voice uttered by a human is hardly the white noise. Therefore, if the noise signal generated in the above-mentioned way is used just as it is, the sound quality with uncomfortable feeling likely occurs. By contrast, for instance, when a low pass filter with loose roll-off characteristic, e.g. a first-order FIR (Finite Impulse Response) filter having zero-order and first-order coefficients of 0.5, is applied to the envelope shaping section 36, the envelope-adjusted noise signal can be made so as to have the sound quality with small uncomfortable feeling.

The gain controlling section 37 is configured to generate a first provisional additional voice signal by multiplying the broad band signal from the band broadening section 34 by a first gain value, and to generate a second provisional additional voice signal by multiplying the envelope-adjusted noise signal from the envelope shaping section 36 by a second gain value. The gain controlling section 37 then transmits the resultant first and second provisional additional voice signals to the adding section 38.

For avoiding the improved voice 53 to be output from the voice decoding apparatus 10 of the third embodiment from becoming noisy, with regard to the voiced sound, the second gain value is determined relatively smaller than the first gain value. The first and second gain values may be affected mutually or determined individually. Both gain values may be values determined in advance or adaptively varied in response to the inputted decoded voice signal. For instance, the likelihood of voiced sound LV is determined by a first-order autocorrelation coefficient and the first and second gain values G1 and G2 are determined according to numerical expressions (1) and (2):

$$G1=(LV+1)/2 \quad (1)$$

$$G2-1-G1 \quad (2)$$

Because the first-order autocorrelation coefficient of the voiced sound is positive, the likelihood of voiced sound LV is more than zero. Further, because, in accordance with the expressions (1) and (2), the first gain value G1 is more than 0.5 and the second gain value is less than 0.5, the second gain value is guaranteed to become less than the first gain value.

The adding section 38 is configured to add the first and second provisional additional voice signals to each other and transmit the resultant third provisional additional voice signal to the additional-band filtering section 33.

Now, the operation of the voice decoding apparatus 1C of the third embodiment will be described. The general operation of the voice decoding apparatus 1C may be similar to the first embodiment and a repetitive description is omitted. The operation of the non-linear components generator 4C will be described.

The first decoded voice signal output from the MBE-type decoder 2 is interpolated with the sample interpolating section 31 by inserting a new sample in every sample under the interpolation rule. By this interpolation process, the sampling frequency of the first decoded voice signal is converted from the first sampling frequency to the second sampling frequency. The resultant interpolated voice signal is then transmitted to the band broadening processing section 32. In the band broadening section 34 of the band broadening processing section 32, the non-linear function is performed to the interpolation voice received from the sample interpolating section 31 to generate the signal with the additional voice band's components. The resultant broad band signal is transmitted to the gain controlling section 37.

On the other hand, in the noise generating section 35, the pseudo-random number generating way is applied to generate the noise signal. The noise signal is transmitted to the envelope shaping section 36. In the envelope shaping section 36, the spectral envelope adjusting process is performed to the noise signal. The resultant envelope-adjusted noise signal is transmitted to the gain controlling section 37.

In the gain controlling section 37, the broadband signal from the band broadening section 34 is multiplied by the first gain value to generate the first provisional additional voice signal, and moreover, the envelope-adjusted noise signal from the envelope shaping section 36 is multiplied by the second gain value to generate a second provisional additional voice signal. The first and second provisional additional voice signals are added together in the adding section 38, and then, the resultant third provisional additional voice signal is transmitted to the additional-band filtering section 33.

In accordance with the third embodiment, by including irregularity not generated from the discrete encoding information for each frame in the additional voice band, it is possible to provide the auditor with the voice furthermore improved in the nose clogging feeling of the decoded voice in hearing sense and enhanced in the listening feeling, while maintaining the advantage of obtaining the stable quality of the decoded voice in the MBE-type voice encoding system.

Next, the voice decoding apparatus according to a fourth embodiment of the present invention will be described further with reference to FIG. 5. The fourth embodiment may be different from the first embodiment in the non-linear components generating way performed by the non-linear components generator. As described earlier, the first embodiment generates the non-linear component by carrying out the non-linear process to the decoded voice signal. In the fourth embodiment, a sound source signal and a vocal tract characteristic are estimated from the decoded voice signal by linear prediction analysis. Moreover, the estimated sound source signal is subject to the non-linear process to generate a sound source signal with the additional voice band and the estimated vocal tract characteristic is converted to a parameter with regard to the second sampling frequency. Subsequently, voice synthesis of the generated sound source signal and the converted vocal tract characteristic is carried out to generate the non-linear component.

By learning the conversion of the vocal tract characteristic in advance by means of the actual voices of the first and second sampling frequencies, more natural, improved voice can be expected.

The general configuration of the voice decoding apparatus 1D according to the fourth embodiment may be similar to the configuration as shown in FIG. 1 applied to the first embodiment. The voice decoding apparatus 1D is provided with a non-linear components generator 4D in addition to the MBE-type decoder 2, the sampling convertor 3, and the adder 5.

The non-linear components generator 4D is different in detail configuration from the above-mentioned embodiments. FIG. 5 is a schematic block diagram showing a detail configuration of the non-linear components generator 4D in the fourth embodiment. In FIGS. 5 and 6, a flow of parameter such as vocal tract characteristic information with the first sampling frequency is represented by a fine broken line and another flow of the parameter with the second sampling frequency is represented by a thick broken line.

Figure 5:
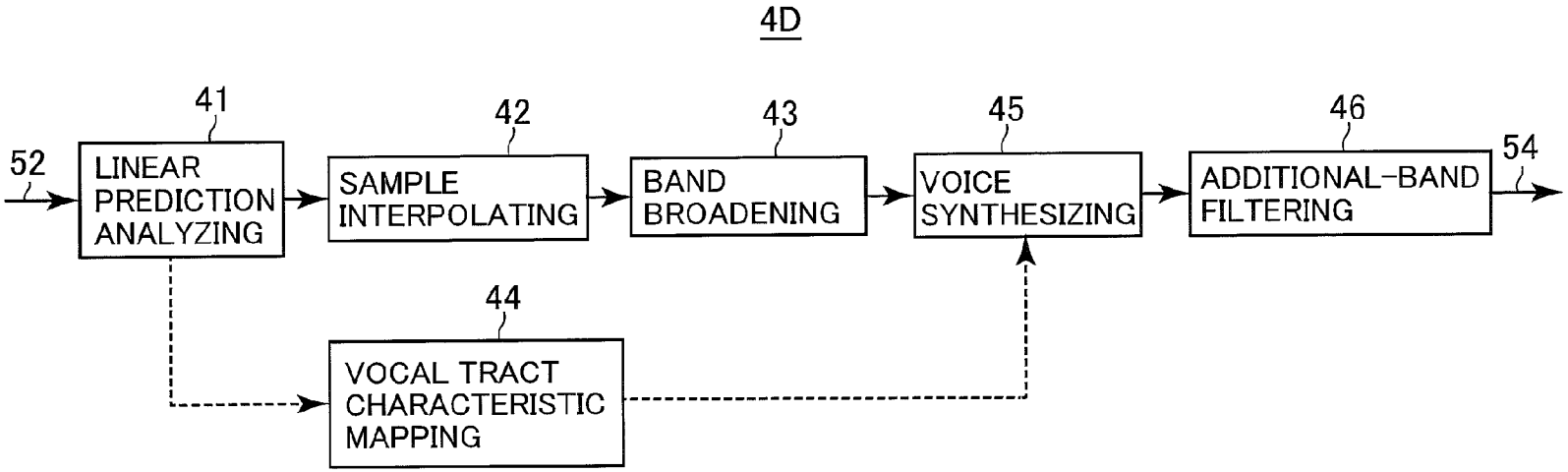
FIG. 5 is a schematic block diagram showing a non-linear components generator in a voice decoding apparatus according to a fourth embodiment of the present invention.
Figure 6:
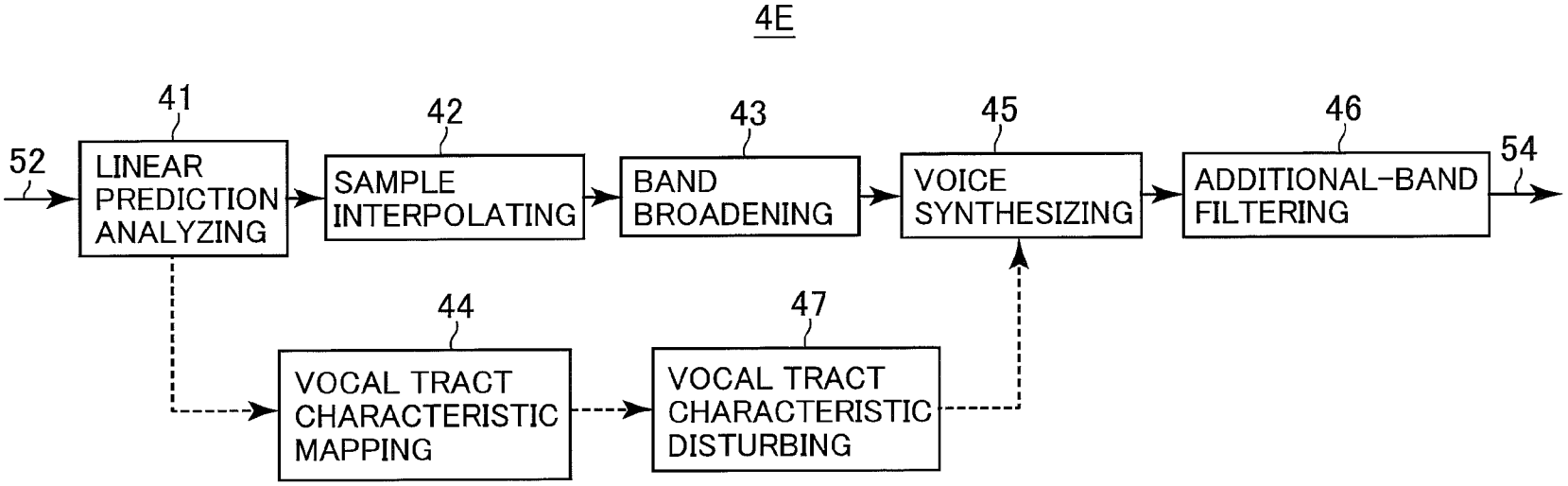
FIG. 6 is a schematic block diagram showing a non-linear components generator in a voice decoding apparatus according to a fifth embodiment of the present invention.

In FIG. 5, the non-linear components generator 4D in the fourth embodiment is provided with a linear prediction analyzing section 41, a sample interpolating section 42, a band broadening section 43, a vocal tract characteristic mapping section 44, a voice synthesizing section 45 and an additional-band filtering section 46.

The linear prediction analyzing section 41 is configured to perform the linear prediction analysis to the first decoded voice signal 52 and transmit the resultant residual signal as the voice source signal to the sample interpolating section 42, and moreover, transmit the resultant linear prediction coefficient or partial autocorrelation coefficient as the voice tract characteristic to the vocal tract characteristic mapping section 44. Generally, before the linear prediction analysis, a process of applying a high band emphasized filter called as pre-emphasis is preferably carried out. For example, the first-order FIR filter with the zero-order coefficient of 1 and the first-order coefficient of 0.97 is often utilized simply. It is therefore preferable that the pre-emphasis is performed as a pre-process of the linear prediction analyzing section 41. Before or after the pre-emphasis, a signal processing for shaping the waveform may be carried out.

The sample interpolating section 42 and the band broadening section 43 are different from the sample interpolating section 11 and the band broadening section 12 of the first embodiment, respectively, in that the voice signals input to the sample interpolating sections may be the first decoded signal and the sound source signal obtained the linear prediction analysis, but may be similar to each other except for such difference. The band broadening processing section 22 of the second embodiment or the band broadening processing section 32 of the third embodiment may be applied to the band broadening section 43. The band broadening section 43 transmits the resultant broad band sound source signal to the voice synthesizing section 45.

The vocal tract characteristic mapping section 44 is configured to map the vocal tract characteristic of the first sampling frequency to the vocal tract characteristic of the second sampling frequency by means of a mapping way and to transmit data on the resultant broad band vocal tract characteristic to the voice synthesizing section 45. As the mapping way, a code book mapping way or an arbitrary linear or non-linear mapping way may be applied. The code book provided for the conversion of the vocal tract characteristic or the linear or non-linear mapping function is learned in advance by using the actual voices of the first and second sampling frequencies. For instance, if a parameter, e.g. autocorrelation coefficient, except the linear prediction coefficient and partial autocorrelation coefficient, is used as input and output information of the mapping way, the data on the vocal tract characteristic from the linear prediction analyzing section 41 may be converted to the predetermined parameter in pre-process of the vocal tract characteristic mapping section 44 and the mapped parameter may be converted to the format capable of being input into the voice synthesizing section 45 in post-process of the vocal tract characteristic mapping section 44. As the pre-process and post-process of the vocal tract characteristic mapping section 44, the vocal tract characteristic or the broad band vocal tract characteristic may be suitably corrected.

The voice synthesizing section 45 is configured to perform the voice synthesis on the basis of the broad band voice source signal and the broad band vocal tract characteristic, and to transmit the resultant provisional additional voice signal to the additional-band filtering section 46.

The additional-band filtering section 46 may be the same as or similar to the additional-band filtering section 13 of the first embodiment and output the resultant additional voice signal to the adder 5.

Now, the operation of the voice decoding apparatus 1D of the fourth embodiment will be described. The general operation of the voice decoding apparatus 1D may be similar to the first embodiment and a repetitive description is omitted. Hereinafter, the operation of the non-linear components generator 4D will be described.

With regard to the first decoded voice signal output from the MBE-type decoder 2, the linear prediction analysis is performed in the linear prediction analyzing section 41. The resultant residual signal is transmitted as the sound source signal to the sample interpolating section 42. The resultant linear prediction coefficient or the partial autocorrelation coefficient is transmitted as the voice tract characteristic to the vocal tract characteristic mapping section 44.

The sound source signal is interpolated with the sample interpolating section 42 by inserting a new sample in every sample under the interpolation rule. By this interpolation process, the sampling frequency of the sound source signal is converted from the first sampling frequency to the second sampling frequency. With regard to the resultant interpolated sound source signal, the non-linear process is performed by the band broadening section 43 to generate the broadband sound source signal with the additional voice band's components. The broad band sound source signal is transmitted to the voice synthesizing section 45.

On the other hand, the vocal tract characteristic with the first sampling frequency output from the linear prediction analyzing section 41 is mapped to another vocal tract characteristic with the second sampling frequency by the vocal tract characteristic mapping section 44. The resultant broad band vocal tract characteristic is transmitted to the voice synthesizing section 45.

In the voice synthesizing section 45, the voice synthesis is performed on the basis of the broad band sound source signal and broad band vocal tract characteristic and the resultant provisional additional voice signal is transmitted to the additional-band filtering section 46. By the additional-band filtering section 46, the additional voice band is filtered from the provisional additional voice signal. The resultant, i.e. remaining, additional voice signal is transmitted to the adder 5.

In accordance with the fourth embodiment, the band of the sound source signal is broadened by means of the mapping way learned on the basis of the actual voices of the first and second sampling frequencies and is reflected to the final decoded voice signal. It is thereby possible to provide an auditor with the natural voice improved in the nose clogging feeling of the decoded voice in hearing sense and enhanced in the listening feeling, while maintaining the advantage of obtaining the stable quality of the decoded voice in the MBE-type voice encoding system.

Next, the voice decoding apparatus according to a fifth embodiment of the present invention will be described further with reference to FIG. 6. The voice decoding apparatus of the fifth embodiment is configured by suitably modifying the voice decoding apparatus of the fourth embodiment to further reduce the nose clogging feeling of the decoded voice signal.

The fifth embodiment may be different from the fourth embodiment in the non-linear component generating way performed by the non-linear components generator. In the fourth embodiment, the vocal tract characteristic with the broadened band is applied to the voice synthesis just as it is.

However, the vocal tract characteristic before broadening the band may be influenced by the discrete encoding information for each frame and the influence may remain on the vocal tract characteristic with the broadened band. Accordingly, the influence of the encoding information may be reflected to the additional voice band, and accordingly, the effect of improving the nose clogging feeling may be limitative.

Thereupon, in the fifth embodiment, the vocal tract characteristic with the broadened band is disturbed by using the pseudo-random number. According to this, irregularity not generated from the encoding information is included in the additional voice band's components and it is expected that the voice further improved in the nose clogging feeling is obtained.

The general configuration of the voice decoding apparatus 1E according to the fifth embodiment may be similar to the configuration as shown in FIG. 1 applied to the first and fourth embodiments. The voice decoding apparatus 1E is provided with a non-linear components generator 4E in addition to the MBE-type decoder 2, the sampling convertor 3, and the adder 5.

The non-linear components generator 4E is different in detail configuration from the above-mentioned embodiments. FIG. 6 is a schematic block diagram showing a detail configuration of the non-linear components generator 4E in the fifth embodiment. The components and signals in FIG. 6 similar to or correspondent with the components in FIG. 5 of the fourth embodiment are indicated by the similar or correspondent reference numerals.

In FIG. 6, the non-linear components generator 4E in the fifth embodiment is provided with a vocal tract characteristic disturbing section 47 in addition to the linear prediction analyzing section 41, the sample interpolating section 42, the band broadening section 43, the vocal tract characteristic mapping section 44, the voice synthesizing section 45 and the additional-band filtering section 46. The components except for the section 47 may have the same functions as the corresponding components of the fourth embodiment and a repetitive description of their functions is omitted.

The vocal tract characteristic disturbing section 47 is interposed in a path from the vocal tract characteristic mapping section 44 to the voice synthesizing section 45. The vocal tract characteristic disturbing section 47 is configured to disturb the broad band vocal tract characteristic by using a random number series obtained by means of a pseudo-random number generating way and transmit the resultant data on disturbed broad band vocal tract characteristic to the voice synthesizing section 45. The pseudo-random number generating way is not limited to a specific way and any existing way may be applied. For instance, a linear congruential way or a way of using a linear feedback shift register may be applied as the pseudo-random number generating way. The disturbing degree is preferably smaller. It is preferable that the variation amount of the disturbance is, for example, less than ten percent of a standard deviation of elements of the broad band vocal tract characteristic. This is because, if the disturbing degree is too large, a new noise occurs and a voice synthesis output obtained from the vocal tract characteristic becomes unstable. Moreover, the generated random number series may be used after being smoothed in an arbitrary axis direction. For instance, the random number series is preferably smoothed in the time direction by leak integration defined by the numerical expression (3):

$$R'_{k,n}=a*R'_{k,n-1}+(1-a)*R'_{k,n} \quad (3)$$

In the expression (3), a subscript k indicates an element number of the random series and smoothed random series, a subscript n indicates a time frame number, $R_{k,n}$ indicates the random series, $R'_{k,n}$ indicates the smoothed random series. The coefficient a is determined in advance in a range of 0-1, preferably 0.5.

In the non-linear components generator 4E in the fifth embodiment, since the vocal tract characteristic disturbing section 47 is provided, the broadband vocal tract characteristic output from the vocal tract characteristic mapping section 44 is disturbed by the vocal tract characteristic disturbing section 47. The resultant data on disturbed broad band vocal tract characteristic is transmitted to the voice synthesizing section 45 and used for the voice synthesis in the voice synthesizing section 45 together with the broadband sound source signal from the band broadening section 43.

In accordance with the fifth embodiment, by including the irregularity not generated from the discrete encoding information for each frame in the additional voice band, it is possible to provide the auditor with the voice furthermore improved in the nose clogging feeling of the decoded voice in hearing sense and enhanced in the listening feeling, while maintaining the advantage of obtaining the stable quality of the decoded voice in the MBE-type voice encoding system.

Although various modified embodiments have been described in the above, further modified embodiments can be made as illustrated below.

Above-mentioned embodiments are directed to one kind of way for improving the quality of the first decoded voice from the MBE-type decoder. However, the voice decoding apparatus may be configured so as to implement a plurality of improving ways which are selectable by the user.

Instead of selecting one of the improving ways, the voice decoding apparatus may be configured so that the user can determine whether or not the improving way is applied. Alternatively, such determination may be automatically worked instead of the operation of the user. For instance, a device calculates characteristic values with regard to the first decoded voice signal, such as the power and average value of LPC (Linear Predictive Coding) coefficients of every degree, and compares the resultant characteristic value with a threshold value. Subsequently, according to the comparison result, the device may decide whether or not the improving way for the first decoded voice signal as mentioned in connection with the embodiments is applied.

In the above-mentioned embodiments, the improving process of the quality is carried out at the stage where the first decoded voice signal is obtained by synthesizing, e.g. adding, the decoded voiced and voiceless sound. However, the improving process of the quality may be carried out at a stage before the voiced sound and the voiceless sound are synthesized. In the latter case, the quality improving ways for the decoded voiced and voiceless sound may be different from each other. In addition, it may be configured so as to select, for each sound, the kind of the quality improving ways or determine whether or not the quality improving way is applied. For instance, the quality improving way for the voiced sound may be carried out at all times and application of the quality improving way for the voiceless sound may be selected by the user. Although the claims of the patent application do not explicitly define the quality improvement in a condition where the voiced and voiceless sounds are separated, the claims shall be interpreted so as to include the quality improvement in such a condition.

The above-mentioned embodiments are directed to the decoding of the voice signal. However, the technical idea of the present invention can be applied to decoding of an acoustic signal in MBE-type encoding system capable of applying to the acoustic signal. The term "voice" in the claims has to be interpreted so as to include the "acoustic".

Each element constituting the voice decoding apparatus may be arbitrarily installed into a device or on a semiconductor chip, although their description is omitted in respect of the above-mentioned embodiments. For instance, the MBE-type decoder 2 may be implemented on an IC (Integrated Circuit) chip, and the sampling convertor 3, non-linear components generators 4A-4E and adder 5 may be implemented in software to be executed by the CPU. Alternatively, the sampling convertor 3, non-linear components generators 4A-4E and adder 5 may be implemented on an IC chip and marketed separately from the MBE-type decoder 2.

The voice decoding apparatus in the embodiments and modification thereof can be implemented by a voice decoding program or program product causing a computer to function as the voice decoding apparatus. The program can be stored in a non-transitory computer-readable medium, and loaded to a computer.

The entire disclosure of Japanese patent application No. 2014-049149 filed on Mar. 12, 2014, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What I claim is:

1. A voice decoding apparatus for decoding digital voice-encoded information encoded in accordance with a Multi-Band Excitation (MBE)-type voice encoding system, the voice decoding apparatus comprising:

an MBE-type decoder decoding the digital voice-encoded information to generate a first decoded voice signal with a first sampling frequency;

a sampling convertor converting the first decoded voice signal to a second decoded voice signal with a second sampling frequency higher than the first sampling frequency;

a non-linear components generator performing a non-linear process to the first or second decoded voice signal to generate an additional voice signal with the second sampling frequency, the additional voice signal having frequency components in a frequency band in which the first decoded voice signal has no frequency component, and having no frequency component in another frequency band in which the first decoded voice signal has frequency components; and an adder adding the second decoded voice signal and the additional voice signal to each other to thereby produce an output voice signal, wherein said non-linear components generator includes:

a band broadening section performing the non-linear process to the second decoded voice signal to generate a provisional additional voice signal having components in a frequency band in which the first decoded voice signal has no component, and an additional-band filtering section cutting off the frequency band in which the first decoded voice signal has components from the provisional additional voice signal to filter the frequency band in which the first decoded voice signal has components from the provisional additional voice signal.

2. The voice decoding apparatus in accordance with claim 1, wherein said non-linear components generator includes:

a sample interpolating section interpolating the first decoded voice signal to generate an interpolated voice signal up-sampled to the second sampling frequency;

a band broadening section performing the non-linear process to the interpolated voice signal to generate a provisional additional voice signal having components in a frequency band in which the first decoded voice signal has no component; and an additional-band filtering section cutting off the frequency band in which the first decoded voice signal has components from the provisional additional voice signal to filter the frequency band in which the first decoded voice signal has no component.

3. The voice decoding apparatus in accordance with claim 2, wherein said band broadening section performs a non-linear amplitude modulation to a signal input to said band broadening section.

4. The voice decoding apparatus in accordance with claim 2, wherein said band broadening section includes:

a band broadening element performing said non-linear process to an input voice signal to generate a broad band signal having the components in the frequency band in which the first decoded voice signal has no component;

a noise generator generating a noise signal;

an envelope shaping section shaping a spectral envelope of said noise signal to generate an envelope-adjusted noise signal;

a gain controlling section adjusting gains of the broad band signal and envelope-adjusted noise signal and outputting adjusted signals; and an adding section adding two signals output from said gain controlling section.

5. The voice decoding apparatus in accordance with claim 4, wherein said band broadening element performs a non-linear amplitude modulation to a signal input to said band broadening element.

6. The voice decoding apparatus in accordance with claim 1, wherein said band broadening section performs a non-linear amplitude modulation to a signal input to said band broadening section.

7. The voice decoding apparatus in accordance with claim 1, wherein said band broadening section includes:

a band broadening element performing said non-linear process to an input voice signal to generate a broadband signal having the components in the frequency band in which the first decoded voice signal has no component;

a noise generator generating a noise signal;

an envelope shaping section shaping a spectral envelope of said noise signal to generate an envelope-adjusted noise signal;

a gain controlling section adjusting gains of the broad band signal and envelope-adjusted noise signal and outputting adjusted signals; and an adding section adding two signals output from said gain controlling section.

8. The voice decoding apparatus in accordance with claim 7, wherein said band broadening element performs a non-linear amplitude modulation to a signal input to said band broadening element.

9. The voice decoding apparatus in accordance with claim 1, wherein said non-linear components generator includes:

a linear prediction analyzing section performing linear prediction analysis of the first decoded voice signal to calculate a sound source signal and a vocal tract characteristic;

a sound source sample interpolating section interpolating the sound source signal to generate an interpolated sound source signal up-sampled to the second sampling frequency;

a band broadening section performing said non-linear process to the interpolated sound source signal to generate a broad band sound source signal having components in the frequency band in which the first decoded voice signal has no component;

a vocal tract characteristic mapping section mapping the vocal tract characteristic to a broad band vocal tract characteristic with regard to the second sampling frequency;

a voice synthesizing section performing a voice synthesis by synthesizing the broad band sound source signal and the broad band vocal tract characteristic; and an additional-band filtering section cutting off the frequency band in which the first decoded voice signal has components from an output of said voice synthesizing section to filter the frequency band in which the first decoded voice signal has no component from the output.

10. The voice decoding apparatus in accordance with claim 9, wherein said non-linear components generator includes a vocal tract characteristic disturbing section of disturbing the broad band vocal tract characteristic output from said vocal tract characteristic mapping section and transmitting the disturbed signal to said voice synthesizing section.

11. The voice decoding apparatus in accordance with claim 10, wherein said band broadening section includes:

a band broadening element performing said non-linear process to a voice signal input to said band broadening section to generate a broad band signal having the components in the frequency band in which the first decoded voice signal has no component;

a noise generator generating a noise signal;

an envelope shaping section shaping a spectral envelope of the noise signal to generate an envelope-adjusted noise signal;

a gain controlling section adjusting gains of the broad band signal and envelope-adjusted noise signal and outputting adjusted signals; and an adding section adding two signals output from said gain controlling section.

12. The voice decoding apparatus in accordance with claim 11, wherein said band broadening element performs a non-linear amplitude modulation to a signal input to said band broadening element.

13. The voice decoding apparatus in accordance with claim 10, wherein said band broadening section performs a non-linear amplitude modulation to a signal input to said band broadening section.

14. The voice decoding apparatus in accordance with claim 9, wherein said band broadening section includes:

a band broadening element performing said non-linear process to a voice signal input to said band broadening section to generate a broad band signal having the components in the frequency band in which the first decoded voice signal has no component;

a noise generator generating a noise signal;

an envelope shaping section shaping a spectral envelope of the noise signal to generate an envelope-adjusted noise signal;

a gain controlling section adjusting gains of the broad band signal and envelope-adjusted noise signal and outputting adjusted signals; and an adding section adding two signals output from said gain controlling section.

15. The voice decoding apparatus in accordance with claim 14, wherein said band broadening element performs a non-linear amplitude modulation to a signal input to said band broadening element.

16. The voice decoding apparatus in accordance with claim 9 wherein said band broadening section performs a non-linear amplitude modulation to a signal input to said band broadening section.

17. A non-transitory computer-readable medium storing a voice decoding program for causing a computer, which implements a voice decoding apparatus for decoding digital voice-encoded information encoded in accordance with a Multi-Band Excitation (MBE)-type voice encoding system, to function as:

an MBE-type decoder decoding the digital voice-encoded information to generate a first decoded voice signal with a first sampling frequency;

a sampling convertor converting the first decoded voice signal to a second decoded voice signal with a second sampling frequency higher than the first sampling frequency;

a non-linear components generator performing a non-linear process to the first or second decoded voice signal to generate an additional voice signal with the second sampling frequency, the additional voice signal having frequency components in a frequency band in which the first decoded voice signal has no frequency component, and having no frequency component in another frequency band in which the first decoded voice signal has frequency components; and an adder adding the second decoded voice signal and additional voice signal to each other to thereby produce an output voice signal, wherein said non-linear components generator includes:

a band broadening section performing the non-linear process to the second decoded voice signal to generate a provisional additional voice signal having components in a frequency band in which the first decoded voice signal has no component, and an additional-band filtering section cutting off the frequency band in which the first decoded voice signal has components from the provisional additional voice signal to filter the frequency band in which the first decoded voice signal has components from the provisional additional voice signal.

18. The voice decoding apparatus in accordance with claim 1, wherein the output voice signal sounds naturally.

19. The non-transitory computer-readable medium in accordance with claim 17, wherein the output voice signal sounds naturally.

* * * * *